United States Patent [19]

Brody

[11] Patent Number: 4,805,812

[45] Date of Patent: Feb. 21, 1989

[54] SPRAY CAN ACTUATION DEVICE WITH LOCKING MECHANISM

[75] Inventor: Harvey Brody, Costa Mesa, Calif.

[73] Assignee: Delshar Industries, Inc., Santa Ana, Calif.

[21] Appl. No.: 131,908

[22] Filed: Dec. 11, 1987

[51] Int. Cl.[4] ..... B65D 83/14

[52] U.S. Cl. ..... 222/402.11; 222/402.15; 222/474

[58] Field of Search ..... 222/153, 79, 182, 402.11, 222/402.12, 402.15, 174, 474; 239/DIG. 22; 251/93, 95, 98–99, 106, 108, 110, 115

[56] References Cited

U.S. PATENT DOCUMENTS

| | | | |
|---|---|---|---|
| 679,247 | 7/1901 | Whiting | 251/110 |
| 2,530,583 | 11/1950 | Nurkiewicz | 222/153 X |
| 2,877,934 | 11/1956 | Wallace | 222/323 |
| 3,169,672 | 2/1965 | Soffer et al. | 251/108 X |
| 3,172,582 | 11/1963 | Belpedio | 222/473 |
| 3,189,232 | 10/1962 | Joffe | 222/394 |
| 3,622,053 | 11/1971 | Ryden | 222/402.11 |
| 4,089,440 | 5/1978 | Lee | 222/174 |
| 4,432,474 | 2/1984 | Hutchinson et al. | 222/402.15 |
| 4,442,955 | 4/1984 | Bush | 222/153 |
| 4,449,647 | 5/1984 | Reed et al. | 222/153 |

FOREIGN PATENT DOCUMENTS

| | | |
|---|---|---|
| 1163978 | 9/1969 | United Kingdom . |
| 1343881 | 1/1974 | United Kingdom . |
| 1487719 | 10/1977 | United Kingdom . |
| 2001706 | 2/1979 | United Kingdom . |
| 2038952 | 7/1980 | United Kingdom . |

*Primary Examiner*—Michael S. Huppert
*Attorney, Agent, or Firm*—Klein & Szekeres

[57] ABSTRACT

A spray can holding and actuating device includes a body that is removably attachable to the top of a spray can. The body includes a handle and a valve actuation lever, operated by a trigger, that engages the push-button valve of the spray can when the trigger is pressed. A locking plate is pivotally attached to the front of the body for movement between an unlocked position and a locked position. In the unlocked position, the actuation lever has an unobstructed path for engagement with the valve. When the plate is in the locked position, it locks the actuation lever in a position disengaged from the valve. A trigger lock is advantageously provided selectively to disable the trigger. The trigger lock includes a pin movable between an unlocked position, in which it is received in an orifice in the body when the trigger is pressed, and a locked position, in which the pin engages the body before the trigger is moved sufficiently to bring the actuation lever into operable engagement with the valve.

22 Claims, 2 Drawing Sheets

SPRAY CAN ACTUATION DEVICE WITH LOCKING MECHANISM

BACKGROUND OF THE INVENTION

The present invention relates to a device for both holding a pressurized container, such as a spray can, and for actuating the valve of the container to dispense its pressurized contents. More particularly, the present invention relates to an improvement in such devices, whereby these devices can remain attached to a spray can with much reduced risk of an inadvertent actuation of the valve.

Spray can holding and actuation devices are well known in the art, as exemplified by the following U.S. Pat. Nos.: 2,877,934— Wallace; 3,172,582— Belpedio; 3,189,232— Joffe; and 4,089,440— Lee. Further examples of such actuation devices are disclosed in the following British patent specifications Nos.: 1,163,978; 1,343,881; 1,487,719; 2,001,706 (published application); and 2,038,952 (published application).

Of the prior art spray can actuation devices, one of the more popular types has the general configuration of a pistol, as particularly exemplified in U.S. Pat. No. 4,432,474— Hutchinson et al. These pistol-shaped devices typically include a body that has a pistol-grip handle, and means on the front of the body for removable attachment to the top of a spray can, of the type having a push-button valve. The body carries a valve actuation member that is operably linked or connected to a trigger, the latter being situated with respect to the handle in a manner similar to the trigger of a pistol. The linkage between the actuation member and the trigger is such that when the trigger is squeezed or depressed, the actuation member is brought into operable engagement with the push-button valve, thereby actuating the valve to dispense the contents of the container.

While the prior art spray can actuation devices have added greatly to the convenience and safety of using spray cans, such devices typically lack any effective mechanism for minimizing the possibility of an inadvertent actuation of the spray can valve when a spray can is held by the actuation device, and, especially, during the process of attaching the device to the can. Accordingly, the user must take particular care to prevent the trigger from being inadvertently depressed when using such devices. The need for such care makes these actuation devices less convenient to use, thereby detracting from their utility.

There has thus been a long-felt, but as yet unsatisfied, need for a safety mechanism that can be readily adapted to the prior art spray can holding and actuation devices, and that greatly reduces the possibility of inadvertent actuation of the spray can valve.

SUMMARY OF THE INVENTION

Broadly, the present invention is an improved actuation device of the pistol grip type exemplified by the above-described Hutchinson et al. patent, wherein the improvement comprises means for disabling or locking the push-button valve actution mechanism of the device. More specifically, as discussed above, the piston-grip type device includes an actuation member engageable with the push-button valve of the pressurized container, the actuation member being operatively connected to a trigger, whereby squeezing the trigger brings the actuation member into operative engagement with the push-button valve. The present invention includes at least a first locking means, engageable with the actuation member, for selectively locking the actuation member in a position disengaged from the push-button valve. A second locking means, engageable between the trigger and the body of the device, is advantageously provided for selectively disabling the trigger. The first and second locking means are independently actuable.

In a specific preferred embodiment of the invention, the body of the actuation device includes attachment means for removably attaching the body of the device to a pressurized container, with the actuation member being a lever or arm operatively disposed near the attachment means. The lever has a free end which comes into operable engagement with the push-button valve when the lever is pivoted by means of the trigger. The first locking means is such an embodiment includes a plate having a portion pivotally connected to the body of the device adjacent to the attachment means, the plate having a notch dimensioned to receive the free end of the lever. The plate is pivotable between a first position in which it is out of the path of travel between the free end of the lever and the push-button valve and a second position wherein the free end of the lever is received in the notch so as to be restrained from moving into engagement with push-button valve. The plate is preferably disposed as to be pivotable with respect to the body in a vertical plane. In alternative embodiments, however, the plate may be pivotable in a substantially horizontal plane.

The second locking means advantageously employed as an option in the present invention includes a push-button or pin in the trigger that is movable between an unlocked position and a locked position. In the unlocked position, the pin is received in an orifice in the underside of the body of the device when the trigger is squeezed, thereby allowing the trigger to be moved sufficiently to bring the actuation member into operable engagement with the push-button valve. In the locked position, the pin comes into engaegment with the body when the trigger is squeezed, thereby blocking the trigger from being moved sufficiently to bring the actuation member into operable engagement with the valve.

With either the first or the second locking means set in its locked position, the actuation member of the actuation and holding device is effectively blocked from coming into operative engagement with the push-button valve of a container to which the actuation and holding device is attached. Thus, the possibility of inadvertent actuation of the valve is substantially reduced. The redundancy of first and second independently actuable locking means further reduces the changes of inadvertent actuation. Alternatively, the user can select whichever of the two locking means he or she finds more convenient, although it is contemplated that the first locking means, which engages the actuation member directly, will be the principal one relied upon by most users.

The improvements of the present invention can be incorporated into existing actuation and holding devices, of the pistol-grip type exemplified by the Hutchinson et al. patent, without extensive modifications and without adding significantly to the cost of manufacture.

These and other advantages of the present invention will be better appreciated from the detailed description which follows.

DETAILED DESCRIPTION OF THE INVENTION

Figure 1:
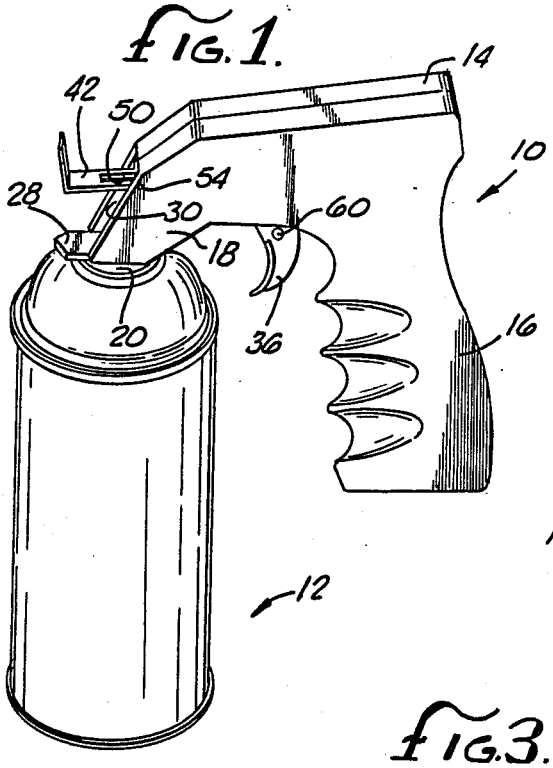
FIG. 1 is a perspective view of an actuation and holding device, in accordance with the preferred embodiment of the present invention, attached to a pressurized container.
Figure 2:
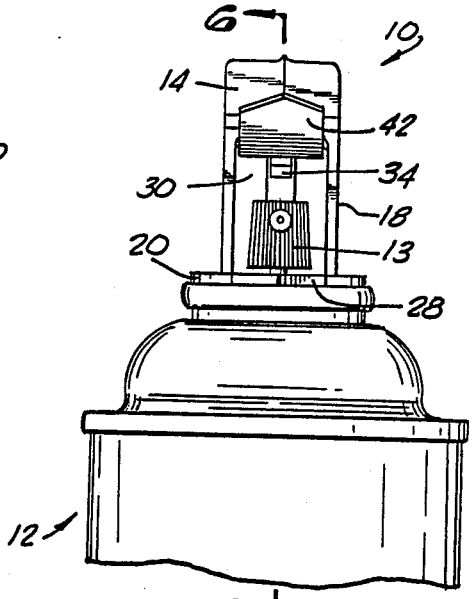
FIG. 2 is a front elevational view of the embodiment of FIG. 1, showing the actuation and holding device attached to the container.
Figure 4:
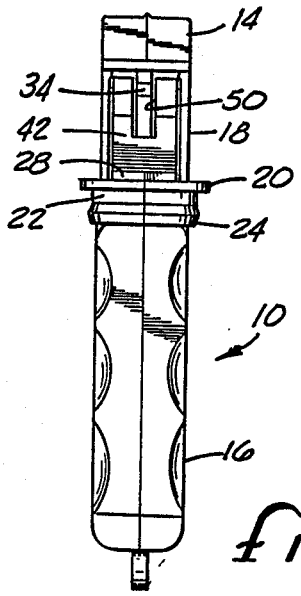
FIG. 4 is a front elevational view of the preferred embodiment of the present invention.
Figure 3:
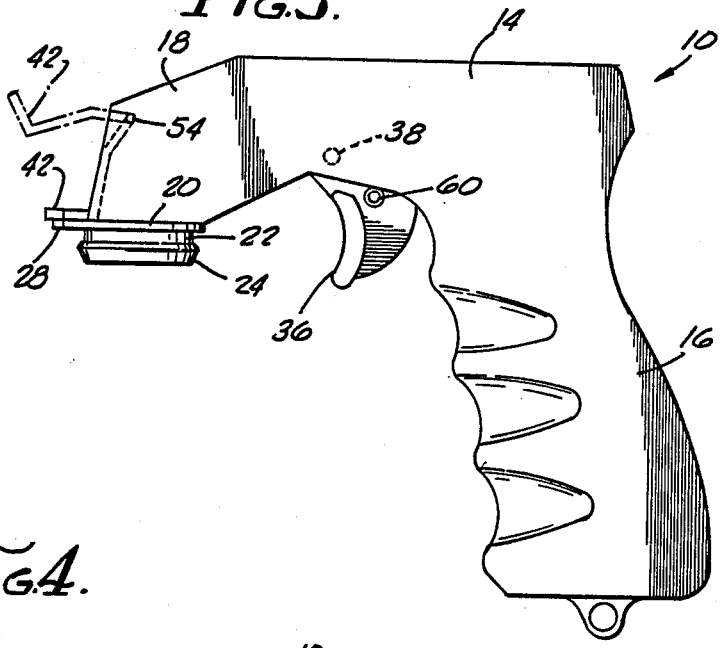
FIG. 3 is a side elevational view of the preferred embodiment of the present invention.
Figure 6:
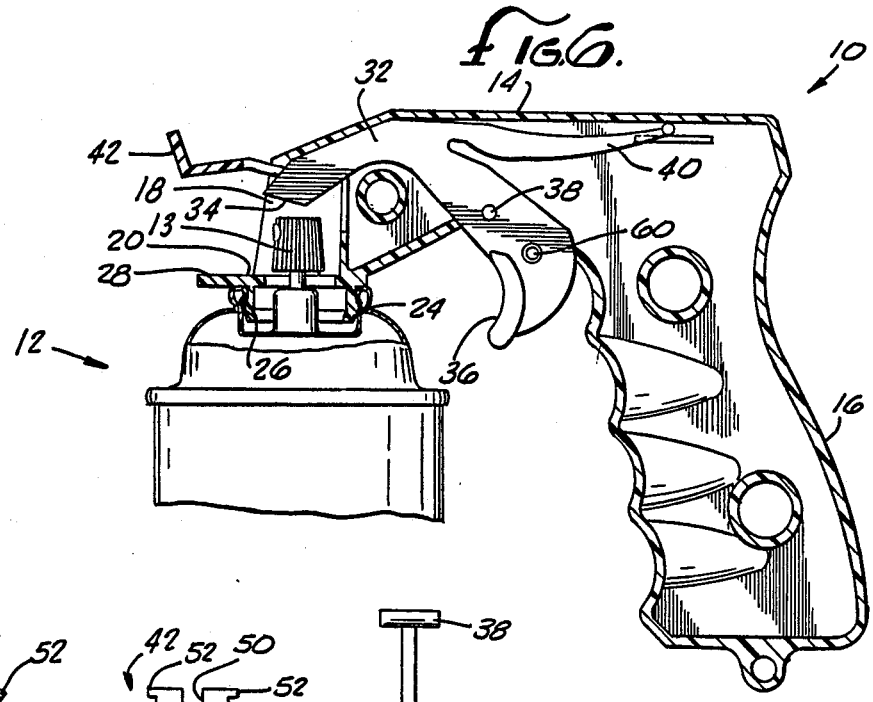
FIG. 6 is a cross-sectional view of the preferred embodiment of the present invention, showing the invention attached to a pressurized container.

Referring now to the drawings, FIGS. 1 and 2 show an improved actuation and holding device 10, in accordance with the preferred embodiment of the present invention, attached to a pressurized container 12, having a push-button spray valve 13. The actuation and holding device 10 has a body 14 that would typically be made of molded plastic by conventional techniques, well-known in the art. The body 14 includes a pistol grip handle 16 and a front portion 18 that extends in a generally downward direction, terminating in a generally annular shoulder 20. Extending downwardly from the shoulder 20 is an annular extension 22 that terminates in an annular rim 24. As best shown in FIG. 6, the rim 24 is dimensioned to be received in an annular channel 26 formed in the top of the pressurized container 12, around the push-button valve 13. The rim 24 thus provides means from removably attaching the device 10 to the container 12. As will be explained below, it is advantageous to provide a short lip 28 extending forwardly from the shoulder 20.

The front of the body 14 above the shoulder 20 is provided with an opening 30, through which the contents of the container 12 are dispensed from the valve 13. The opening 30 is substantially rectangular in outline and is defined on the bottom by the shoulder 20, and on the sides and top of the wall surfaces of the front portion 18 of the body.

As best shown in FIG. 6, the device 10 includes a valve actuation member comprising a lever 32 disposed longitudinally within the body. The lever 32 has a first or free end 34 which extends through the front portion 18 of the body and into the opening 30, thereby being disposed just above the valve 13. The other end of the lever extends through an opening in the underside of the body and is configured in the shape of a trigger 36. The actuation lever 32 pivots on a pin 38 when the trigger 36 is pressed toward the handle 16, thereby causing the free end 34 to pivot downwardly and come into operative engagement against valve 13. In this manner, the valve 13 is depressed to dispense the contents of the container. The actuation lever 32 may include a resilient, rearwardly-extending extension 40 that engages an interior surface of the body, and that acts as a spring to assist the return of the lever to its original position when the trigger 36 is released. In this original position, the free end 34 of the lever is out of engagement with the valve 13, as shown in FIG. 6.

Figure 7:
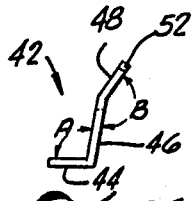
FIG. 7 is a side elevational view of the locking plate used in the embodiment of FIGS. 1 through 6.
Figure 8:
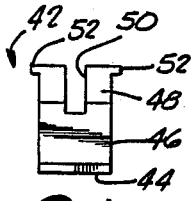
FIG. 8 is a front elevational view of the locking plate shown in FIG. 7.

In accordance with the preferred embodiment of the present invention, first locking means are provided for selectively locking the valve actuation lever 32 in a position disengaged from the valve 13. This first locking means includes a locking plate 42. As best shown in FIG. 7, the locking plate 42 includes a substantially horizontal base portion 44, an intermediate portion 46 joined to the base portion 44 at a slightly obtuse angle A, and and upper portion 48 joined to the intermediate portion 46 at an obtuse angle B. The upper portion 48 is bifurcated by a slot 50. The upper edge of the upper portion 48 is provided with a pair of outwardly extending ears 52 that are registrable and engageable with a pair of apertures 54 in the front portion 18 of the body, on opposite sides of the opening 30.

With the ears 52 engaged in the apertures 54, the plate 42 is mounted for pivotal movement in a substantially vertical plane into and out of the opening 30. When the plate 42 is pivoted upwardly out of the opening 30, it is in an unlocked position, wherein the free end 34 of the actuation lever 32 is allowed come into operable engagement with the push-button valve 13 when the trigger 36 is pressed. When the plate 42 is pivoted downwardly into the opening 30, it is in a locked position, in which the free end 34 of the actuation lever 32 is received in the notch 50 and is thereby restrained from further movement. In this manner, the actuation lever 32 is locked in a position with its free end 34 disengaged from the valve 13. When the plate 42 is in the locked position, its base 44 rests on the lip 28 extending from the shoulder 20 near the lower end of the front portion 18 of the body 14 of the device 10. This support for the base 44 provides a more secure locking of the actuation lever 32, and a higher degree of reliability in operation.

An advantageous feature of the above described locking mechanism is that when the plate 42 is moved downwardly, it acts as a shield to block the spray from the valve 13, should the free end 34 of the actuation lever 32 somehow fail to be received in the notch 50.

Figure 5:
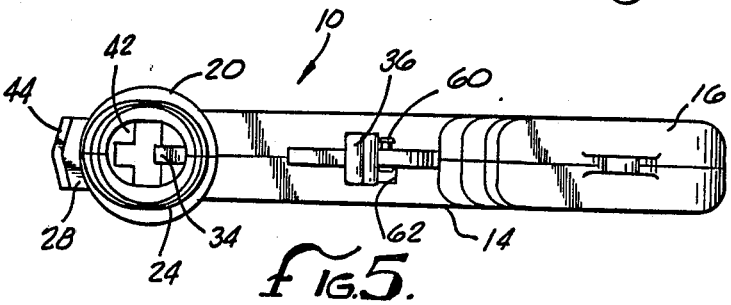
FIG. 5 is a bottom plan view of the preferred embodiment of the present invention.
Figure 9:
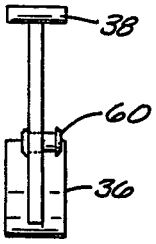
FIG. 9 is a detailed view of the trigger locking or trigger safety mechanism employed in the preferred embodiment of the invention.

The device 10 is advantageously provided with an optional second locking mechanism that operates directly on the trigger 36. This trigger locking mechanism, best shown in FIGS. 5, 6 and 9, provides an alternative safety mechanism that can be used instead of or, preferably, in conjunction with, the locking plate 42 described above. Specifically, the trigger locking mechanism includes a pin or push-button 60 that is mounted for reciprocal movement within the trigger 36. The push-button 60 is movable between a first position and a second position. In the first, or unlocked position, the push-button 60 is received in an orifice 62 in the underside of the body 14, as shown in FIG. 5. Thus, when the pin 60 is in the unlocked position, the trigger 36 is movable through its full range of motion, so that when it is pressed, the actuation lever 32 can likewise be moved through its full range of motion to actuate the valve 13.

When the push-button 60 is moved to its second or locked position, it is out of alignment with the orifice 62. Thus, in this locked position, the push-button 60 comes into engagement against the underside of the body 14 when the trigger 36 is pressed, thereby blocking the trigger from being moved a sufficient amount to bring the actuation lever 32 into engagement with the push-button valve 13.

It will be readily appreciated that the push-button 60 and the plate 42 are independently actuable, so that the two locking mechanisms can be used either separately or together.

Figure 10:
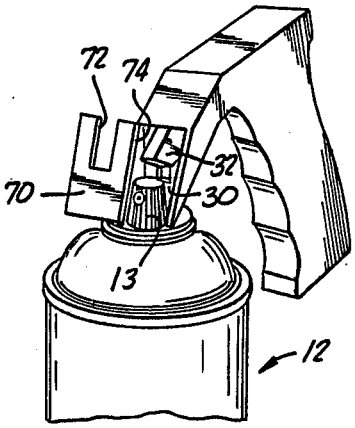
FIG. 10 is a front perspective view of a first alternative embodiment of the present invention, showing a first variation in the design of the actuation member locking plate.
Figure 11:
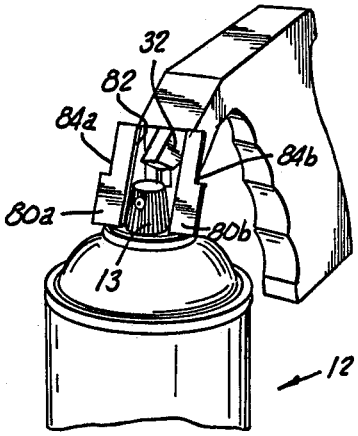
FIG. 11 is a front perspective view of a second alternative embodiment of the present invention, showing a second variation in the design of the actuation member locking plate.

FIGS. 10 and 11 illustrate alternative embodiments that employ variations in the design of the actuation member locking plate. Specifically, FIG. 10 shows an embodiment having a locking plate 70 that is a unitary element bifurcated at the top by a notch 72. The plate 72 has one side edge attached by an integral or "living" hinge 74 to the wall of the body along one side of the opening 30. The hinge 74 allows the plate 70 to pivot in a nearly horizontal plane into and out of the opening 30. When the plate 70 is pivoted out of the opening, it is in its unlocked position, wherein the actuation lever 32 is allowed to come into engagement with the valve 13. When the plate 70 is pivoted into the opening 30, it is in its locked position, wherein the free end 34 of the actuation lever is received in the notch 72 thereby blocking the actuation member from coming into engagement with the valve 13.

In the FIG. 11 embodiment, the actuation member locking plate is divided vertically into two plate segments 80a and 80b. The plate segments are pivotally attached to the body of the device on opposite sides of the opening 30, preferably by integral hinges 82, so that they can be pivoted in a substantially horizontal plane toward and away from each other. When the plate segments are pivoted away from each other, they are pivoted out of the opening 30 into an unlocked position, wherein the actuation lever can operably engage the valve 13. When the plane segments **80*a* and 80*b* are pivoted toward each other into the opening 30, they form a locking element substantially in the same shape as the locking plate 70 of the FIG. 10 embodiment. Thus each of the plate segments 80*a* and 80*b* has a free side edge, 84*a* and 84*b*, respectively, the upper portion of which is recessed, so that when the plate segments 80*a* and 80*b* are pivoted toward each other, a notch similar to the notch 72 in the FIG. 10 embodiment is formed. When the plate segments 80*a* and 80*b* are pivoted toward each other, the actuation member is caught in a notch and is restrained from engaging the push-button valve 13**.

From the foregoing description, it can be seen that the present invention provides an effective way of locking the valve actuation mechanism of the actuation and holding device in an inoperable position when the actuation and holding device is attached to a pressurized container, as well as during the process of attaching the device to the container. The preferred embodiment, which employs two independently actuable locking mechanisms, offers the user a choice of using either locking mechanism or both. It is contemplated that the actuation member locking mechanism, comprising, in the preferred embodiment, the locking plate 42, will be preferred by most users, since it gives a good visual indication of whether it is in a locked or unlocked state. It is therefore contemplated that there will be those skilled in the pertinent arts who will consider the trigger locking mechanism to be an optional feature that can be omitted as a cost-saving measure.

Although a preferred embodiment and several variations of the preferred embodiment have been described herein, other variations and modifications will suggest themselves to those skilled in the pertinent arts. For example, the specific configuration of the actuation member locking plate maybe altered to accomodate different configurations of the valve actuation member in a variety of actuation and holding devices. Similarly, different pistol grip designs may dictate alternative arrangements for effectuating an engagement between the trigger and the body of the device as a means of locking the trigger in an inoperable position. These and other modifications should be considered to be within the spirit and scope of the claims which follow.

What is claimed is:

1. An improved actuation device for holding a pressurized container and actuating a push button valve in the top of the container to dispense the pressurized contents thereof, the device having a body including a handle, attachment means for removably attaching the body to the container, an actuation member engageable with the push button valve for actuation thereof, and trigger means, operatively connected to the actuation member, and operable by a user to bring the actuation member into operable engagement with the push button valve, the actuation member including a lever operatively connected to the trigger means, the lever having a free end that is engageable with the push button valve, characterized by:

actuation member locking means operatively connected to the front of the body of the actuation device, and selectively movable between a first position in which the actuation member is engageable against the push button valve by operation of the trigger means, and a second position that locks the actuation member in a disengaged position from the push button valve, the actuation member locking means comprising:

a plate having a portion pivotally connected to the body of the device, the plate having a notch dimensioned to receive the free end of the lever, the plate being pivotable between the first position wherein it is out of the path of travel between the free end of the lever and the push button valve, and the second position wherein the free end of the lever is received in the notch so as to be restrained from moving into engagement with the push button valve.

2. The actuation device of claim 1, wherein the plate has an upper end pivotally connected to the body, so that the plate is pivotable substantially in a vertical plane.

3. The actuation device of claim 1, wherein the plate notch is defined within the upper side of the plate, the plate having a side edge pivotally connected to the body, so that the plate is pivotable in a nearly horizontal plane.

4. The actuation device of claim 3, wherein the plate comprises first and second plate segments, the first plate segment having a side edge pivotally connected to one side of the body, the second plate segment having a side edge pivotally connected to the opposite side of the body, the first and second plate segments being pivotable toward each other to form the plate.

5. The actuation device of claim 1, further characterized by:

trigger locking means operatively associated with the trigger means and the body, for selectively preventing the operation of the trigger means to bring the actuation member into operable engagement with the push-button valve.

6. The actuation device of claim 5, wherein the trigger locking means selectively restrains the trigger means from being moved by the user sufficiently to bring the actuation member into operable engagement with the push-button valve.

7. The actuation device of claim 6, wherein the trigger means includes a trigger means movable by the user toward and away from the body, and wherein the trigger locking means comprises a button in the trigger member, the button being movable between a locking position in which it engages the body when the trigger member is moved toward the body, and an unlocking position in which it is received in an orifice in the underside of the body when the trigger member is moved toward the body, thereby allowing the trigger member to be moved sufficiently to bring the actuation member into operable engagement with the push-button valve.

8. An improved actuation device for holding a pressurized container and actuating a push button valve in the top of the container to dispense the pressurized contents thereof, the device having a body including a handle, attachment means for removably attaching the body to the container, an actuation member engageable with the push button valve for actuation thereof, and trigger means operatively connected to the actuation member, and operable by a user to bring the actuation member into operable engagement with the push button valve, characterized by:

actuation member locking means, engageable with the actuation member, for selectively locking the actuation member in a position disengaged from the push button valve;

wherein the locking means comprises:

a locking plate pivotally attached to the body adjacent the actuation member and movable between a first position out of engagement with the actuation member and a second position in locking engagement with the actuation member whereby the actuation member is blocked from operatively engaging the push button valve when the locking plate is in the second position, the locking plate having a notch that receives the actuation member when the locking plate is in the second position, the actuation member being engaged by the locking plate when the actuation member is received in the notch.

9. The actuation device of claim 8, further comprising trigger locking means, engageable between the trigger means and the body, for selectively disabling the trigger means, the trigger-locking means and the actuation member locking means being independently actuable.

10. The actuation device of claim 9, wherein the trigger means is movable between a first position in which the actuation member is disengaged from the push-button valve and a second position in which the actuation member is brought into operable engagement with the push-button valve, and wherein the trigger locking means blocks the trigger means from being moved from the first position to the second position.

11. The actuation device of claim 10, wherein the trigger locking means includes a movable button in the trigger means, the button being selectively movable between (a) a locking position in which the button engages the body of the actuation device as the trigger means is moved toward the second position thereby blocking the trigger means from reaching the second position, and (b) an unlocking position in which the button is received in an orifice in the underside of the body when the trigger means is moved toward the second position whereby allowing the trigger means to reach the second position.

12. The actuation device of claim 8, wherein the body has an opening in the front portion thereof proximate the actuation member, and wherein the locking plate is pivotally attached to the body near the top of the opening, whereby the locking plate is pivotable in a vertical direction between the first position and the second position.

13. The actuation device of claim 8, wherein the body has an opening in the front portion thereof proximate the actuation member, and wherein the locking plate is pivotally attached to the body along the side of the opening, whereby the locking plate is pivotable in a substantially horizontal direction between the first and second positions.

14. The actuation device of claim 13, wherein the locking plate comprises first and second plate segments pivotally attached to the body on opposite sides of the opening, whereby the plate segments are pivotable toward each other to form the locking plate.

15. An improved actuation device for holding a pressurized container and actuating a push button valve in the top of the container to dispense the contents thereof, the device having a body including a handle, attachment means for removably attaching the body to the container, an actuation member engageable with the push button valve for actuation thereof, the trigger means, operatively connected to the actuation member and operable by a user to bring the actuation member into operable engagement with the valve by movement of the trigger means in a first direction, characterized by:

user-actuable locking means, operatively associated with the body, for substantially blocking movement of the trigger means in the first direction thereby preventing the actuation member from operatively engaging the push button valve;

wherein the user-actuable locking means includes actuation member locking means, selectively engageable between the body and the actuation member, for locking the actuation member in a position disengaged from the push button valve when the actuation member locking means is in a position of engagement between the body and the actuation member;

the actuation member locking means comprising:

a locking plate pivotally attached to the body adjacent the actuation member and movable between a first position out of engagement with the actuation member and a second position in locking engagement with the actuation member, whereby the actuation member is blocked from operatively engaging the push button valve when the locking plate is in the second position, the locking plate having a notch that receives the actuation member when the locking plate is in the second position, the actuation member being engaged by the locking plate when the actuation member is received in the notch.

16. The actuation device of claim 15, wherein the user-actuable locking means further comprises:

trigger locking means engageable between the trigger means and the body, and selectively movable between first and second positions, whereby the trigger locking means is engageable with the body only when in the first position to block the movement of the trigger means in the first direction.

17. The actuation device of claim 16, wherein the trigger locking means comprises:

the movable button in the trigger means, the button being selectively movable between the first and second positions, whereby the button is engageable with the body only when in the first position to block the movement of the trigger means in the first direction.

18. The actuation device of claim 15, wherein the useractuable locking means further comprises:

trigger locking means, actuable independently from the actuation member locking means, engageable between the trigger means and the body, and selectively movable between a first position, and a second position, whereby the trigger locking means is engageable with the body only when in the first position whereby the trigger means is substantially blocked from movement in the first direction when the trigger locking means is in the first position and whereby the trigger means is movable in the first direction when the trigger locking means is in the second position.

19. The actuation device of claim 18, wherein the trigger locking means comprises:

a movable button in the trigger means, the button being movable between the first and second positions, whereby the button is engageable with the body only when in the first position to block the movement of the trigger means in the first direction.

20. The actuation device of claim 15, wherein the body has an opening in the front portion thereof proximate the actuation member, and wherein the locking plate is pivotally attached to the body near the top of the opening, whereby the locking plate is pivotable in a vertical direction between the first position and the second position.

21. The actuation device of claim 15, wherein the body has an opening in the front portion thereof proximate the actuation member and wherein the locking plate is pivotally attached to the body along the side of the opening whereby the locking plate is pivotable in a substantially horizontal direction between the first and second positions.

22. The actuation device of claim 21, wherein the locking plate comprises first and second plate segments pivotally attached to the body on opposite sides of the opening, whereby the plate segments are pivotable toward each other to form the locking plate.

* * * * *